US007065841B2

(12) United States Patent
Sjoquist

(10) Patent No.: US 7,065,841 B2
(45) Date of Patent: Jun. 27, 2006

(54) MAGNETIC FASTENER

(76) Inventor: Clarisse Sjoquist, 1010 N. Manhattan Ave. #9, Manhattan, KS (US) 66502

( * ) Notice: Subject to any disclaimer, the term of this patent is extended or adjusted under 35 U.S.C. 154(b) by 78 days.

(21) Appl. No.: 10/781,139

(22) Filed: Feb. 18, 2004

(65) Prior Publication Data

US 2005/0177985 A1 Aug. 18, 2005

(51) Int. Cl.
*A44B 21/00* (2006.01)

(52) U.S. Cl. ..... 24/303

(58) Field of Classification Search ..... 24/303, 24/379.1, 114.7; 2/265
See application file for complete search history.

(56) References Cited

U.S. PATENT DOCUMENTS

| | | | | | |
|---|---|---|---|---|---|
| 2,389,298 | A | | 11/1945 | Ellis | |
| 2,397,931 | A | | 4/1946 | Ellis | |
| 3,111,737 | A | * | 11/1963 | Heil | 24/303 |
| 3,141,216 | A | * | 7/1964 | Haskell | 24/303 |
| 3,324,521 | A | * | 6/1967 | Humiston | 24/303 |
| 3,372,443 | A | * | 3/1968 | Daddona, Jr. | 24/303 |
| 4,265,002 | A | | 5/1981 | Hosken | |
| 4,399,595 | A | | 8/1983 | Yoon et al. | |
| 4,453,294 | A | | 6/1984 | Morita | |
| 4,736,494 | A | * | 4/1988 | Marchesi | 24/303 |
| 4,847,959 | A | * | 7/1989 | Shimada et al. | 24/671 |
| 4,924,559 | A | * | 5/1990 | Marchesi | 24/303 |
| 5,103,501 | A | | 4/1992 | Meisels | |
| 5,125,134 | A | | 6/1992 | Morita | |
| 5,255,417 | A | * | 10/1993 | Herman | 24/113 MP |
| 5,450,658 | A | * | 9/1995 | Hicks | 24/303 |
| 5,604,960 | A | * | 2/1997 | Good | 24/303 |
| 5,707,091 | A | | 1/1998 | Morita | |
| 5,926,925 | A | * | 7/1999 | Hicks | 24/303 |
| 6,163,938 | A | * | 12/2000 | Weber-Unger | 24/303 |
| 6,226,842 | B1 | | 5/2001 | Wong | |
| 6,301,754 | B1 | | 10/2001 | Grunberger et al. | |
| 6,378,174 | B1 | | 4/2002 | Wong | |
| 6,473,946 | B1 | | 11/2002 | Cheng | |
| 2002/0095751 | A1 | | 7/2002 | Reiter | |

FOREIGN PATENT DOCUMENTS

| | | |
|---|---|---|
| JP | 11-56414 | 3/1999 |

* cited by examiner

*Primary Examiner*—Robert J. Sandy
(74) *Attorney, Agent, or Firm*—Howard & Howard

(57) ABSTRACT

A magnetic fastener (10) for fastening a first flap (12) of material to a second flap (14) of material. A magnet (26) is attached to one of the flaps (12, 14) while a magnetic element (28) is attached to the other flap (14, 12). The natural magnetic attraction between the magnet (26) and the magnetic element (28) keeps the flaps (12, 14) fastened together. A handle (30), preferably embodied as a button (32), is attached to the first flap (12) and interconnected to either the magnet (26) or the magnetic element (28) for allowing the magnetic fastener (10) to be easily opened and closed.

34 Claims, 3 Drawing Sheets

MAGNETIC FASTENER

BACKGROUND OF THE INVENTION

1. Field of the Invention

The subject invention relates to fasteners that function by utilizing magnetism.

2. Description of the Related Art

Numerous magnetic fasteners that include a magnet and a magnetic element are well known in the prior art. An example of such a magnetic fastener is disclosed in the U.S. Pat. No. 2,397,931 to Robert Ellis.

The Ellis patent discloses a magnet with two magnet apertures. The magnet is sewn onto a first flap using a first thread through the magnet apertures. Likewise, a magnetic element also includes two magnetic element apertures. The magnetic element is sewn onto a second flap opposite the magnet. The magnetic element includes a peripheral wall portion and a planer wall portion to define a cavity. When fastened, the magnet resides in the cavity. The natural magnetic attraction between the magnet and magnetic element keep the magnet and magnetic element fastened together.

Although the Ellis patent appears to provide an effective magnetic fastener, a person with only gross motor skills would have difficulty in operating the fastener. Persons who lack fine motor skills often have difficulty with daily tasks that most people take for granted. Putting on and removing clothing is often extremely difficult for those with only gross motor coordination. Operating a normal button-to-buttonhole assembly, without assistance from another person, is sometimes impossible for these individuals. Accordingly, there remains an opportunity for a magnetic fastener that is easily operable by a person lacking fine motor skills.

BRIEF SUMMARY OF THE INVENTION AND ADVANTAGES

The invention provides a magnetic fastener to fasten a first flap of material to a second flap of material. The first flap of material has an inside and an exterior, while the second flap of material has an outside and an interior. A magnetic assembly includes a first portion including at least two first apertures disposed therein and attached to the first flap and a second portion including at least two second apertures disposed therein and attached to the second flap for interconnecting the first flap to the second flap. A first thread passes through the first apertures for attaching the first portion to the inside of the first flap. A second thread passes through the second apertures for attaching the second portion to the outside of the second flap. A handle is attached to the exterior of the first flap and interconnected to the first portion of the magnetic assembly for allowing a person to grasp on to the handle to easily operate the magnetic assembly.

The subject invention also provides a magnetic fastener to fasten a first flap of material to a second flap of material. The first flap of material has an inside and an exterior, while the second flap of material has an outside and an interior. A magnetic assembly includes a first portion attached to the first flap and a second portion attached to the second flap for interconnecting the first flap to the second flap. A button is attached to the exterior of the first flap and directly interconnected with the first portion of the magnetic assembly for allowing a person to grasp the button and operate the magnetic assembly. A buttonhole stitch on the first flap creates the appearance of a standard button-to-buttonhole assembly.

The subject invention further provides a magnetic fastener including a first flap of material having an inside and an exterior and a second flap of material having an outside and an interior. A magnetic assembly includes a magnet attached to the first flap and a magnetic element attached to the second flap for interconnecting the first flap to the second flap. A handle is attached to the exterior of the first flap and directly interconnected with the magnet for allowing a person to grasp the handle and operate the magnetic assembly. The magnetic element includes a peripheral wall portion and a planer wall portion defining a cavity for receiving the magnet. The magnetic element further includes a flange portion extending outwardly from the peripheral wall portion for contacting the magnet during operation of the magnetic fastener such that the magnet can be guided into the cavity.

The subject invention also provides a magnetic fastener including a first flap of material having an inside and an exterior and a second flap of material having an outside and an interior. A magnetic assembly includes a magnetic element attached to the first flap and a magnet attached to the second flap for interconnecting the first flap to the second flap. A handle is attached to the exterior of the first flap and directly interconnected with the magnetic element for allowing a person to grasp the handle and operate the magnetic assembly. The magnetic element including a peripheral wall portion and a planer wall portion defining a cavity for receiving the magnet. The magnetic element further includes a flange portion extending outwardly from the peripheral wall portion for contacting the magnet during operation of the magnetic fastener such that the magnet can be guided into the cavity.

Accordingly, the magnetic fastener is easy to operate and especially useful for persons who lack fine motor coordination. Furthermore, when the magnetic fastener is used on an article of clothing and the handle is embodied as a button, the article of clothing has a standard looking appearance.

BRIEF DESCRIPTION OF THE SEVERAL VIEWS OF THE DRAWINGS

Other advantages of the present invention will be readily appreciated as the same becomes better understood by reference to the following detailed description when considered in connection with the accompanying drawings wherein.

DETAILED DESCRIPTION OF THE INVENTION

Figure 1:
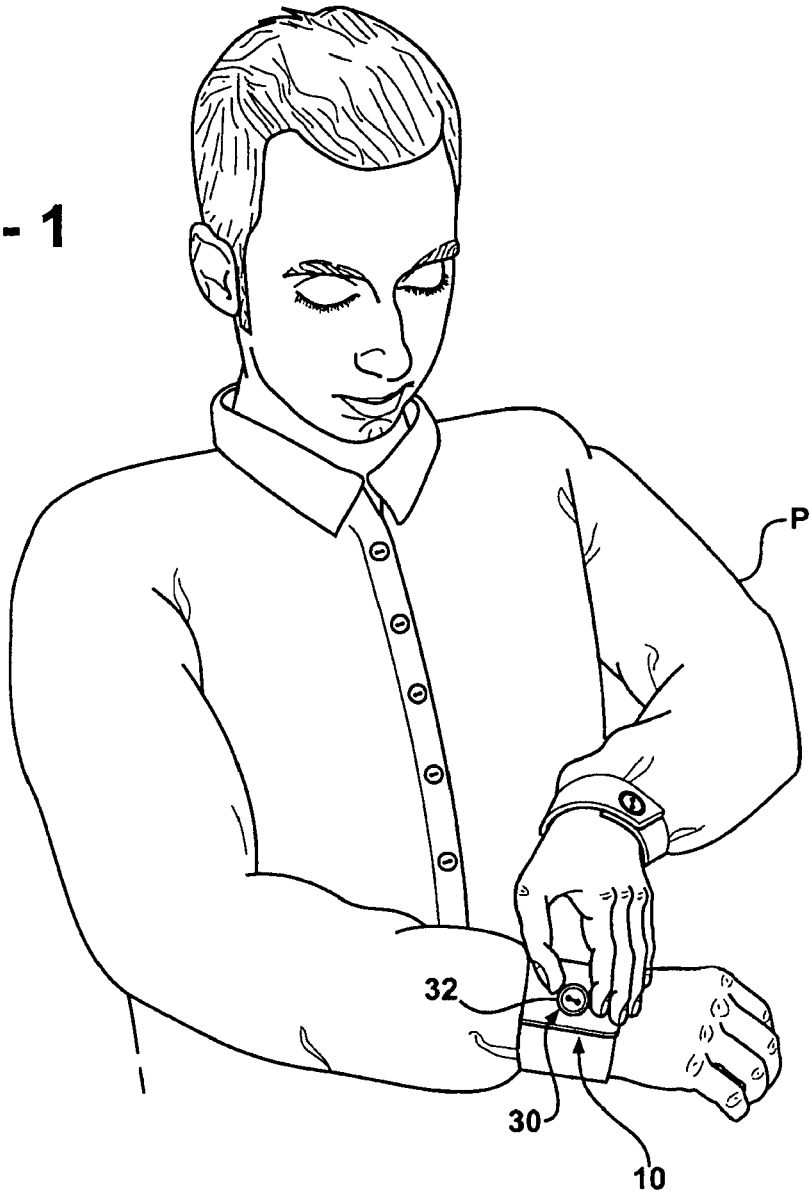
FIG. 1 is a perspective view of a person operating a magnetic fastener in accordance with the subject invention.
Figure 2:
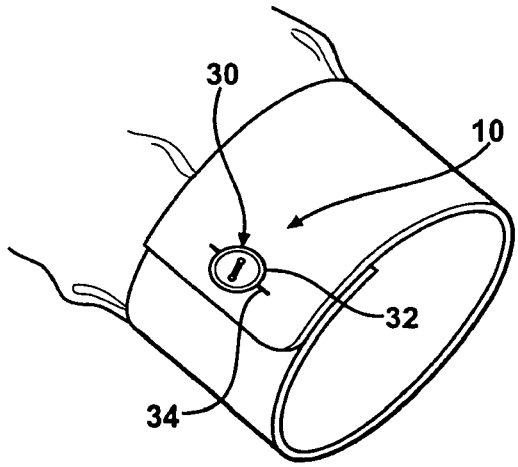
FIG. 2 is a perspective view of the magnetic fastener used on a sleeve of an article of clothing.

Referring to the Figures, wherein like numerals indicate like parts throughout the several views, a magnetic fastener is shown at 10 in FIGS. 1 and 2. The magnetic fastener 10 includes a handle 30 making the fastener 10 easily operable by a person P with only gross motor skills. The magnetic fastener 10 has the outward appearance of a standard button-to-buttonhole assembly. As illustrated, the handle 30 may be embodied as a button 32. Preferably, a buttonhole stitch 34 is added to give the magnetic fastener 10 the complete appearance of a standard button-to-buttonhole assembly. Wearing a garment that looks "normal" helps increase the feeling of self-worth of the person having only gross motor skills. It should be appreciated that the uses for the magnetic fastener 10 of the subject invention are not limited to clothing. Alternatively, the magnetic fastener 10 can also be used with handbags, purses, wallets, or any other suitable device. Those skilled in the art will recognize many other implementations of the magnetic fastener 10.

Figure 3:
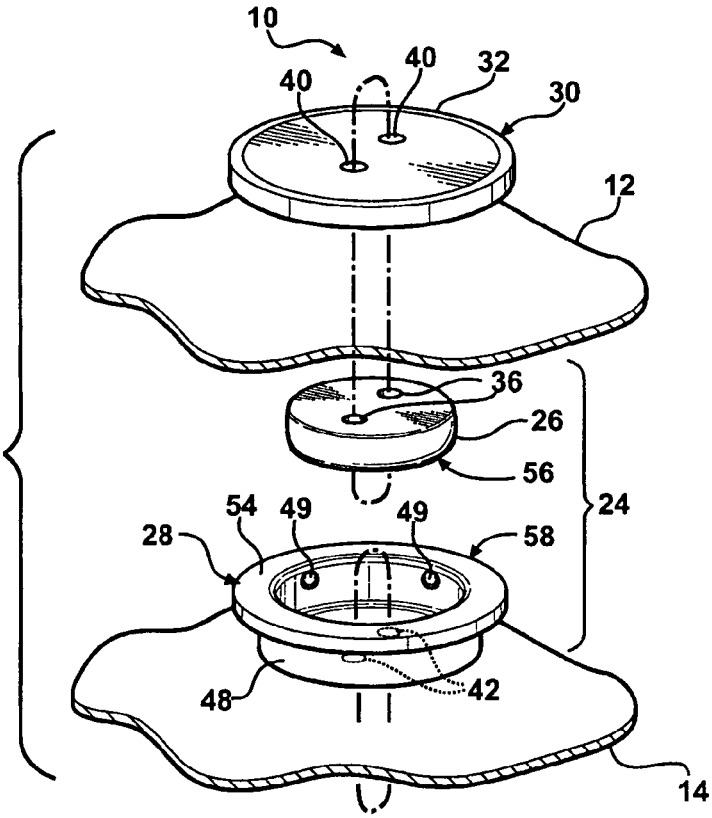
FIG. 3 is an exploded perspective view of a first embodiment of the magnetic fastener.
Figure 4:
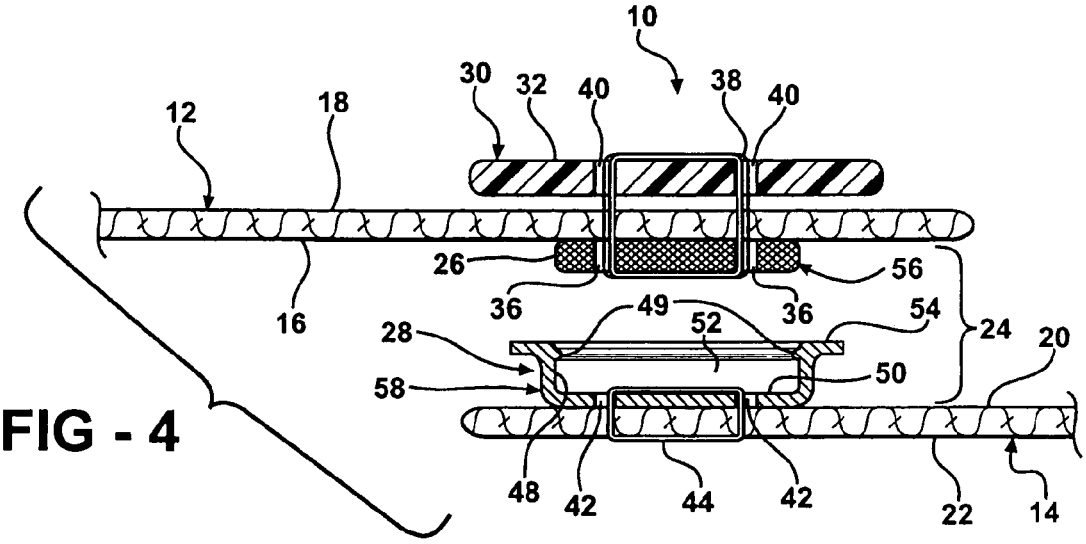
FIG. 4 is a cross-sectional view of the first embodiment of the magnetic fastener before a magnet and a magnetic element are latched together.
Figure 5:
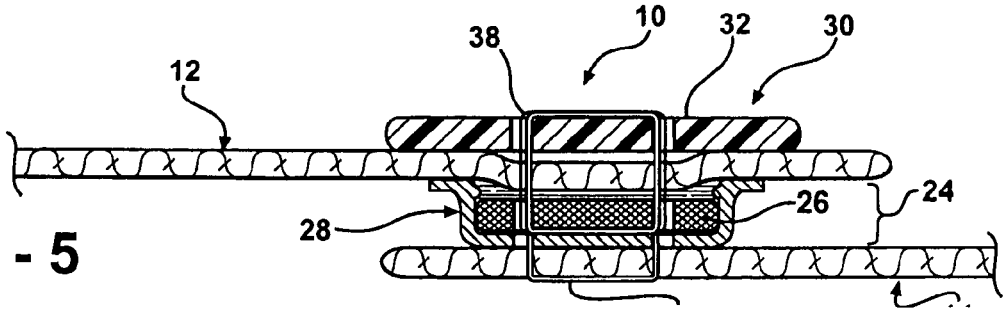
FIG. 5 is a cross-sectional view of the first embodiment of the magnetic fastener after the magnet and the magnetic element are latched together.

FIGS. 3, 4, and 5 illustrate, in greater detail, a first embodiment of the magnetic fastener 10 to interconnect a first flap 12 of material to a second flap 14 of material. As shown in FIG. 3, the magnetic fastener 10 includes a magnetic assembly 24 which comprises a first portion 56 attached to the first flap 12 and a second portion 58 attached to the second flap 14. Preferably, the first portion 56 includes at least two first apertures disposed therein and the second portion 58 includes at least two second apertures disposed therein. A first thread 38 passes through the first apertures to attach the first portion 56 to the inside 16 of the first flap 12. A second thread 44 passes through the second apertures to attach the second portion 58 to the outside of the second flap 14. The magnetic fastener 10 also includes the handle 30.

Referring now to FIG. 4, the first flap 12 of material has an inside 16 and an exterior 18. The second flap 14 of material has an outside 20 and an interior 22. The handle 30 is/attached to the exterior 18 of the first flap 12. The magnetic assembly 24 interconnects the first flap 12 to the second flap 14. In this first embodiment, the first portion 56 of the magnetic assembly 24 is further defined as a magnet 26 which forms a magnetic field, while the second portion 58 is further defined as a magnetic element 28. The magnetic element 28 is formed of a magnetically attractive material and is attached to the outside 20 of the second flap 14.

The magnet 26 is preferably a permanent magnet and may be formed of any number of suitable materials. Ceramic, ferrite, alnico, cobalt, rare earth, neodymium, and other types of permanent magnets are acceptable for use as the magnet 26. It is also preferred that the magnet 26 includes a coating to prevent corrosion of the magnet 26. Depending on the type of permanent magnet utilized, the magnet 26 without a coating may be subjected to rust when the garment is washed or exposed to other sources of moisture. Preferably, the coating is a fluoropolymer resin, such as Teflon® manufactured by E.I. DuPont de Nemours and Company of Wilmington, Del. Teflon® has excellent resistance to both corrosion and high temperatures, making it very suitable to withstand the standard machine washing and drying cycles the garment is likely to be exposed to. Those skilled in the art realize that other coatings, such as, but not limited to nickel, will also produce acceptable corrosion resistance.

The magnetic element 28 is preferably formed of a magnetically attractive metal. Suitable metals include, but are not limited to, steel, stainless steel, aluminum, copper, tin, and any number of metal alloys known to those skilled in the art. The magnetic element 28 may also include a coating, such as, but not limited to, Teflon® or nickel.

In the first embodiment, the at least two second apertures are further defined as at least two magnetic element apertures 42 and are disposed through the magnetic element 28. The at least two first apertures are further defined as the at least two magnet apertures 36 and are disposed through the magnet 26. Additionally, at least two button apertures 40 are disposed through the button 32. It is preferred that the button apertures 40 align with the magnet apertures 36. This alignment allows the first thread 38 to pass through both the button apertures 40 and the magnet apertures 36 to secure them both to the first flap 12 of material. The second thread 44 passes through the magnetic element apertures 42 for attaching the magnetic element 28 to the outside 20 of the second flap 14. Those skilled in the art will realize that other means of attaching the magnet 26 and magnetic element 28 to the first and second flaps 12, 14, aside from apertures 36, 42 and threads 38, 44, may also be implemented.

It is preferred that the magnetic element 28 include a peripheral wall portion 48 and a planer wall portion 50 to define a cavity 52. The magnet 26 is preferably disc-shaped and the cavity 52 is sized appropriately to receive the magnet 26. A natural magnetic attraction causes the magnet 26 and the magnetic element 28 to clasp together. It is also preferred that the magnetic element 28 include at least one tab 49 which protrudes inward from the peripheral wall portion 48. These tabs 49 assist in further securing the magnet 26 in the cavity 52 of the magnetic element 28.

It is further preferred that the magnetic element 28 include a flange portion 54 extending outwardly from the peripheral wall 48. The flange portion 54 allows the magnet 26 to make initial contact with the magnetic element 28. After contact is made, the magnet 26 is easily guided into the cavity 52. Those skilled in the art will also realize that many other shapes and configurations of the magnet 26 and magnetic element 28 could also be implemented.

Referring now to FIG. 5, when the magnet 26 and magnetic element 28 are brought together, the first flap 12 of material becomes fastened to the second flap 14 of material.

Figure 6:
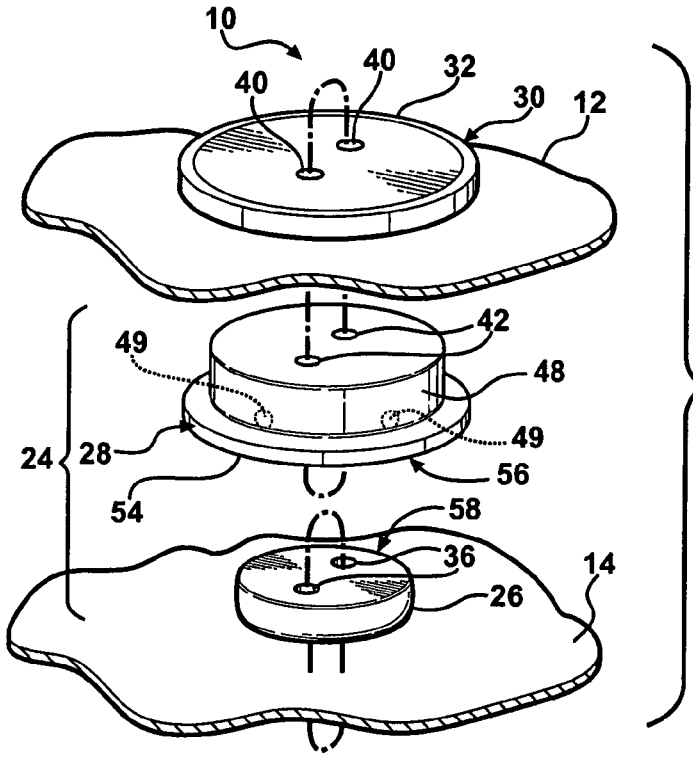
FIG. 6 is an exploded perspective view of a second embodiment of the magnetic fastener.
Figure 7:
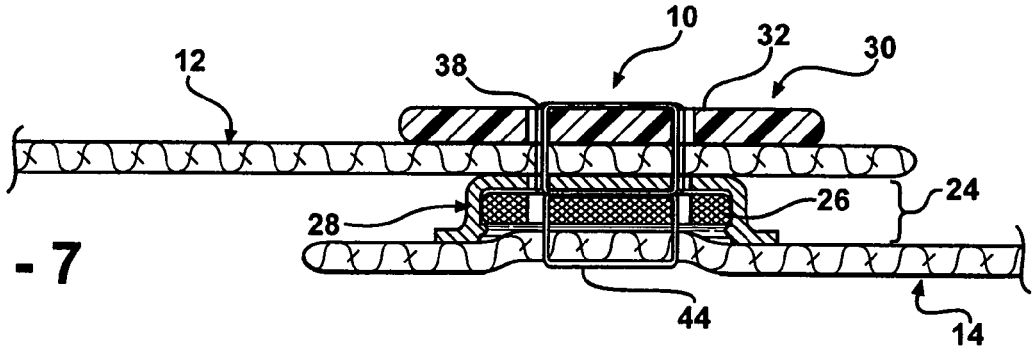
FIG. 7 is a cross-sectional view of the second embodiment of the magnetic fastener.

In a second embodiment, as shown in FIGS. 6 and 7, the second portion 58 of the magnetic assembly 24 is the magnet 26 which is attached to the outside 20 of the second flap 14. The first portion 56 is the magnetic element 28 which is attached to the inside 16 of the first flap 12. The at least two first apertures are the at least two magnet element apertures 42 and the at least two second apertures are the at least two magnetic apertures 36. Again, the button 32 includes button apertures 40 to receive the first thread 38 for attaching the button 32 to the exterior 18 of the first flap 12. It is preferred that the button apertures 40 align with the magnetic element apertures 42 to also accommodate the first thread 38 passing through the magnetic element apertures 42 for attaching the magnetic element 28 to the inside 16 of the first flap 12. The second thread 44 passes through the magnet apertures 36 for attaching the magnet to the outside 20 of the second flap 14.

Figure 8:
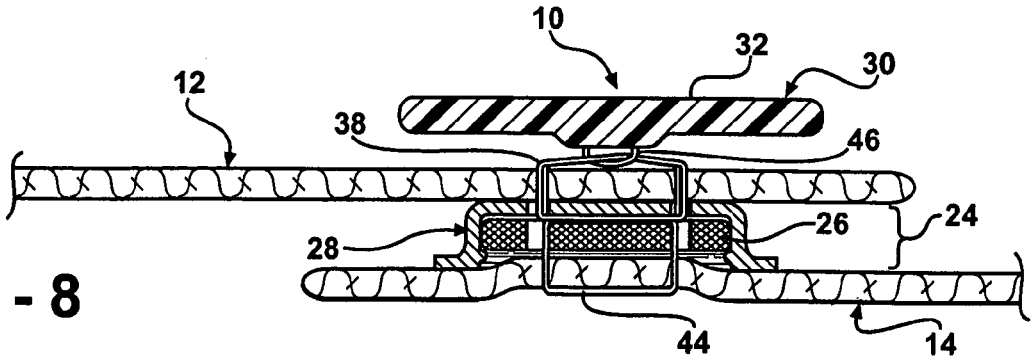
FIG. 8 is a cross-sectional view of a third embodiment of the magnetic fastener.

In a third embodiment, shown in FIG. 8, the button 32 includes a loop 46. The first thread 38 is received by the loop 46 for attaching the button 32 to the exterior 18 of the first flap 12. The first thread 38 also attaches the magnetic element 28 to the inside 16 of the first flap 12. The second thread 44 passes through the magnet apertures 36 for attaching the magnet to the outside 20 of the second flap 14.

Obviously, many modifications and variations of the present invention are possible in light of the above teachings. The invention may be practiced otherwise than as specifically described within the scope of the appended claims, wherein that which is prior art is antecedent to the novelty set forth in the "characterized by" clause. The novelty is meant to be particularly and distinctly recited in the "characterized by" clause whereas the antecedent recitations merely set forth the old and well-known combination in which the invention resides. These antecedent recitations should be interpreted to cover any combination in which the inventive novelty exercises its utility. In addition, the reference numerals in the claims are merely for convenience and are not to be read in any way as limiting.

What is claimed is:

1. A magnetic fastener (10) comprising:

a first flap (12) of material having an inside (16) and an exterior (18);

a second flap (14) of material having an outside (20) and an interior (22);

a magnetic assembly (24) having a first portion (56) including at least two first apertures disposed therein and attached to said first flap (12) and a second portion (58) including at least two second apertures disposed therein and attached to said second flap (14) for interconnecting said first flap (12) to said second flap (14);

a first thread (38) passing through said first apertures for attaching said first portion (56) to said inside (16) of said first flap (12);

a second thread (44) passing through said second apertures for attaching said second portion (58) to said outside (20) of said second flap (14); and a handle (30) attached to said exterior (18) of said first flap (12) and directly interconnected with said first portion (56) of said magnetic assembly (24) for allowing a person to grasp said handle (30) and operate said magnetic assembly (24).

2. A magnetic fastener (10) as set forth in claim 1 wherein said first portion (56) of said magnetic assembly (24) is further defined as a magnet (26) forming a magnetic field and attached to said inside (16) of said first flap (12) by said first thread (38).

3. A magnetic fastener (10) as set forth in claim 2 wherein said magnet (26) is a permanent magnet which forms said magnetic field.

4. A magnetic fastener (10) as set forth in claim 2 wherein said magnet (26) includes a coating for preventing corrosion of said magnet (26).

5. A magnetic fastener (10) as set forth in claim 2 wherein said second portion (58) is further defined as a magnetic element (28) formed of a magnetically attractive material and attached to said outside (20) of said second flap (14) by said second thread (44) for receiving said magnet (26).

6. A magnetic fastener (10) as set forth in claim 5 wherein said at least two first apertures are further defined as at least two magnet apertures (36) with said first thread (38) passing through said magnet apertures (36).

7. A magnetic fastener (10) as set forth in claim 6 wherein said handle (30) is further defined as a button (32).

8. A magnetic fastener (10) as set forth in claim 7 wherein said button (32) includes at least two button apertures (40) for receiving said first thread (38) and attaching said button (32) to said exterior (18) of said first flap (12).

9. A magnetic fastener (10) as set forth in claim 8 wherein said button apertures (40) align with said magnet apertures (36) for allowing said first thread (38) to pass through both of said button apertures (40) and said magnet apertures (36).

10. A magnetic fastener (10) as set forth in claim 7 wherein said button (32) includes a loop (46) for receiving said first thread (38) and attaching said button (32) to said exterior (18) of said first flap (12).

11. A magnetic fastener (10) as set forth in claim 5 wherein said at least two second apertures are further defined as at least two magnetic element apertures (42) with said second thread (44) passing through said magnetic element apertures (42).

12. A magnetic fastener (10) as set forth in claim 5 wherein said magnetic element (28) is formed of a metal.

13. A magnetic fastener (10) as set forth in claim 7 wherein said button (32) is formed of a non-magnetic material.

14. A magnetic fastener (10) as set forth in claim 13 wherein said button (32) is formed of plastic.

15. A magnetic fastener (10) as set forth in claim 1 wherein said first portion (56) of said magnetic assembly (24) is defined as a magnetic element (28) formed of a magnetically attractive material and attached to said inside (16) of said first flap (12) for receiving said second portion (58).

16. A magnetic fastener (10) as set forth in claim 15 wherein said magnetic element (28) is formed of a metal.

17. A magnetic fastener (10) as set forth in claim 15 wherein said second portion (58) of said magnetic assembly (24) is further defined as a magnet (26) attached to said outside (20) of said second flap (14).

18. A magnetic fastener (10) as set forth in claim 17 wherein said at least two second portion apertures are further defined as at least two magnet apertures (36) and said second thread (44) passes through said magnet apertures (36) for attaching said magnet (26) to said outside (20) of said second flap (14).

19. A magnetic fastener (10) as set forth in claim 17 wherein said magnet (26) is a permanent magnet which forms said magnetic field.

20. A magnetic fastener (10) as set forth in claim 17 wherein said magnet (26) includes a coating for preventing corrosion of said magnet (26).

21. A magnetic fastener (10) as set forth in claim 15 wherein said at least two first portion apertures are further defined as at least two magnetic element apertures (42).

22. A magnetic fastener (10) as set forth in claim 21 wherein said handle (30) is further defined as a button (32).

23. A magnetic fastener (10) as set forth in claim 22 wherein said button (32) is formed of a non-magnetic material.

24. A magnetic fastener (10) as set forth in claim 23 wherein said button (32) is formed of plastic.

25. A magnetic fastener (10) as set forth in claim 22 wherein said button (32) includes at least two button apertures (40) for receiving said first thread (38) and attaching said button (32) to said exterior (18) of said first flap (12).

26. A magnetic fastener (10) as set forth in claim 25 wherein said button apertures (40) align with said magnetic element apertures (42) for allowing said first thread (38) to pass through both of said button apertures (40) and said magnetic element apertures (42).

27. A magnetic fastener (10) as set forth in claim 22 said button (32) includes a loop (46) for receiving said first thread (38) and attaching said button (32) to said exterior (18) of said first flap (12).

28. A magnetic fastener (10) comprising:

a first flap (12) of material having an inside (16) and an exterior (18);

a second flap (14) of material having an outside (20) and an interior (22);

a magnetic assembly (24) having a magnetic element (28) attached to said first flap (12) and a magnet (26)

attached to said second flap (14) for interconnecting said first flap (12) to said second flap (14);

a handle (30) attached to said exterior (18) of said first flap (12) and directly interconnected with said magnetic element (28) for allowing a person to grasp said handle (30) and operate said magnetic assembly (24);

said magnetic element (28) including a peripheral wall portion (48) and a planer wall portion (50) defining a cavity (52) for receiving said magnet (26); and said magnetic element (28) further including a flange portion (54) extending outwardly from said peripheral wall portion (48) for making contact with said magnet (26) so said magnet (26) can be guided into said cavity (52).

29. A magnetic fastener (10) as set forth in claim 28 wherein said magnetic element (28) further includes at least one tab (49) protruding inward from said peripheral wall portion (48) to further secure said magnet (26) in said cavity (52).

30. A magnetic fastener (10) comprising:

a first flap (12) of material having an inside (16) and an exterior (18);

a second flap (14) of material having an outside (20) and an interior (22);

a magnetic assembly (24) having a first portion (56) attached to said first flap (12) and a second portion (58) attached to said second flap (14) for interconnecting said first flap (12) to said second flap (14);

a button (32) attached to said exterior (18) of said first flap (12) and directly interconnected with said first portion (56) of said magnetic assembly (24) for allowing a person to grasp said button (32) and operate said magnetic assembly (24); and a buttonhole stitch (34) on said first flap (12) for creating the appearance of a standard button-to-buttonhole assembly.

31. A magnetic fastener (10) as set forth in claim 30 wherein said first portion (56) of said magnetic assembly (24) is further defined as a magnet (26) forming a magnetic field and attached to said inside (16) of said first flap (12) and said second portion (58) is further defined as a magnetic element (28) formed of a magnetically attractive material and attached to said outside (20) of said second flap (14) for receiving said magnet (26).

32. A magnetic fastener (10) as set forth in claim 30 wherein said first portion (56) of said magnetic assembly (24) is defined as a magnetic element (28) formed of a magnetically attractive material and attached to said inside (16) of said first flap (12) for receiving said second portion (58) and said second portion (58) of said magnetic assembly (24) is further defined as a magnet (26) attached to said outside (20) of said second flap (14).

33. A magnetic fastener (10) comprising:

a first flap (12) of material having an inside (16) and an exterior (18);

a second flap (14) of material having an outside (20) and an interior (22);

a magnetic assembly (24) having a magnet (26) attached to said first flap (12) and a magnetic element (28) attached to said second flap (14) for interconnecting said first flap (12) to said second flap (14);

a handle (30) attached to said exterior (18) of said first flap (12) and directly interconnected with said magnet (26) for allowing a person to grasp said handle (30) and operate said magnetic assembly (24);

said magnetic element (28) including a peripheral wall portion (48) and a planer wall portion (50) defining a cavity (52) for receiving said magnet (26); and said magnetic element (28) further including a flange portion (54) extending outwardly from said peripheral wall portion (48) for contacting said magnet (26) during operation of said magnetic fastener such that said magnet (26) can be guided into said cavity (52).

34. A magnetic fastener (10) as set forth in claim 33 wherein said magnetic element (28) further includes at least one tab (49) protruding inward from said peripheral wall portion (48) to further secure said magnet (26) in said cavity (52).

* * * * *